US007922600B1

(12) United States Patent
Ambrose

(10) Patent No.: US 7,922,600 B1
(45) Date of Patent: Apr. 12, 2011

(54) GOLF CLUB WEIGHT SYSTEM AND METHOD

(76) Inventor: John M. Ambrose, Jefferson, OH (US)

( * ) Notice: Subject to any disclaimer, the term of this patent is extended or adjusted under 35 U.S.C. 154(b) by 177 days.

(21) Appl. No.: 12/243,994

(22) Filed: Oct. 2, 2008

(51) Int. Cl.
*A63B 53/06* (2006.01)

(52) U.S. Cl. ..... 473/312; 473/338

(58) Field of Classification Search ..... 473/334–335, 473/338, 340–341, 312, 311
See application file for complete search history.

(56) References Cited

U.S. PATENT DOCUMENTS 3,394,745 A * 7/1968 Kuchins ..... 81/19
5,039,098 A * 8/1991 Pelz ..... 473/306
5,205,553 A * 4/1993 Okumoto et al. ..... 473/312
5,540,435 A * 7/1996 Kawasaki ..... 473/309
5,573,468 A * 11/1996 Baumann ..... 473/312
6,089,991 A * 7/2000 Yeh ..... 473/305
2009/0176593 A1 * 7/2009 Raley ..... 473/219

FOREIGN PATENT DOCUMENTS

JP 11047318 A * 2/1999

* cited by examiner

*Primary Examiner* — Stephen L. Blau

(57) ABSTRACT

An adjustable weight system for golf clubs improves a golfer's swing and feel as the club strikes the ball. The weight system includes a golf club having a shaft attached thereto which includes an internal channel for receiving cylindrical weights. The golf club head attached to the shaft includes a weight port which is in communication with the shaft channel and is closed, preferably with a threaded fastener. The method of use includes removing the fastener and inserting the desired weights to enhance the golfer's swing.

10 Claims, 3 Drawing Sheets

GOLF CLUB WEIGHT SYSTEM AND METHOD

FIELD OF THE INVENTION

The invention herein pertains to golf clubs and particularly pertains to a weight system for golf clubs having a shaft channel for selectively receiving weights therein for improving the golfer's swing.

DESCRIPTION OF THE PRIOR ART AND OBJECTIVES OF THE INVENTION

In selecting golf clubs a golfer generally decides which clubs are the right size and "feel". After playing several rounds of golf with the clubs the golfer may decide that different weight clubs are better suited for his game. The golfer will then return to the retail outlet and purchase another set or model of clubs to improve his game. The selection again is often based on the weight and the resulting "feel" for the different weighted clubs. Often the clubs selected still do not feel correct and the golfer must either adjust his swing or accept the weight of the clubs purchased.

Thus with the problems, expenses and disadvantages of selecting and purchasing standard golf clubs the present invention was conceived and one of its objectives is to provide a golf club having an adjustable weight system to assist the golfer in obtaining the best and most comfortable clubs for his game.

It is another objective of the present invention to provide an adjustable weight system which allows the golfer to obtain a more precise "feel" as wanted for his clubs.

It is still another objective of the present invention to provide an adjustable weight system whereby the weight of the clubs can be easily adjusted depending on the golfer's choice at the time of play.

It is yet another objective of the present invention to provide an adjustable weight system whereby the weight of a particular golf club can be easily increased or decreased with a simple hand tool depending on the golfer's desires.

It is a further objective of the present invention to provide a golf club whereby a threaded fastener can be removed from the bottom of the golf club head for access to weights contained within the golf club shaft.

Various other objectives and advantages of the present invention will become apparent to those skilled in the art as a more detailed description is set forth below.

SUMMARY OF THE INVENTION

The aforesaid and other objectives are realized by providing a golf club having an adjustable weight system whereby one or more cylindrically shaped weights can be inserted through a weight port on or at the bottom of the golf club head and into a channel in the lower portion of the golf club shaft. The selected weights can vary in length and mass to afford the golfer a very precise weight adjustment. A threaded fastener is affixed in the weight port of the club head to prevent the weights from inadvertently falling out or being removed. In the preferred form of the invention the weights consist of one or more cylindrical metal rods. In an alternate embodiment of the invention a cylindrical rod of sufficient weight is affixed to or integrally formed with a threaded fastener.

The adjustable weight system allows the golfer to fine tune the weight of the golf club for a more comfortable, desired weight and feel for the particular golf club. In the method of use a golfer can remove the threaded fastener from the club head weight port, insert one or more weights as required into the lower shaft channel and then replace and tighten the fastener to maintain the inserted weights in place.

DETAILED DESCRIPTION OF THE PREFERRED EMBODIMENT AND OPERATION OF THE INVENTION

Figure 1:
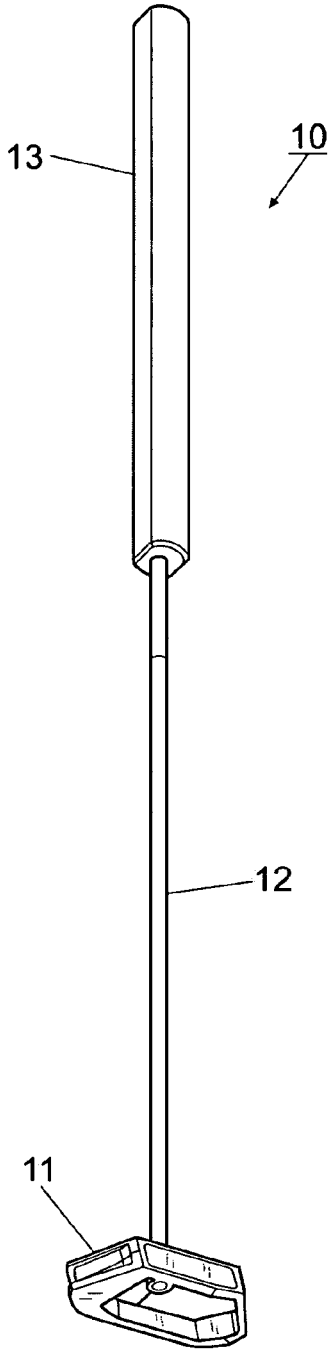
FIG. 1 demonstrates a putter having a weight port at the bottom of the club head.
Figure 2:
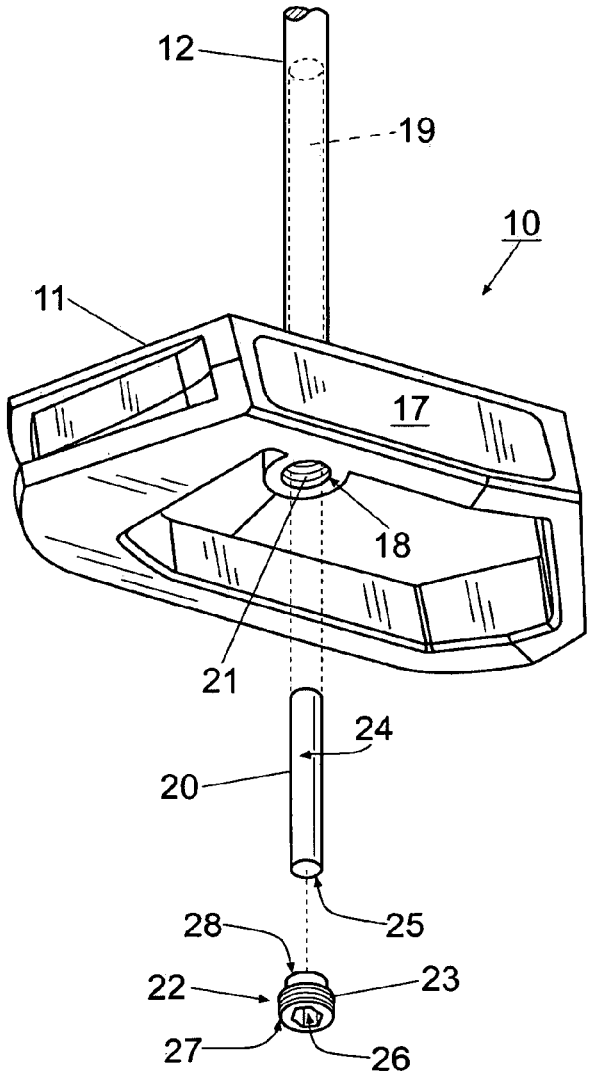
FIG. 2 shows an enlarged partial view of the putter as shown in FIG. 1 with a weight and threaded fastener exploded therefrom.
Figure 3:
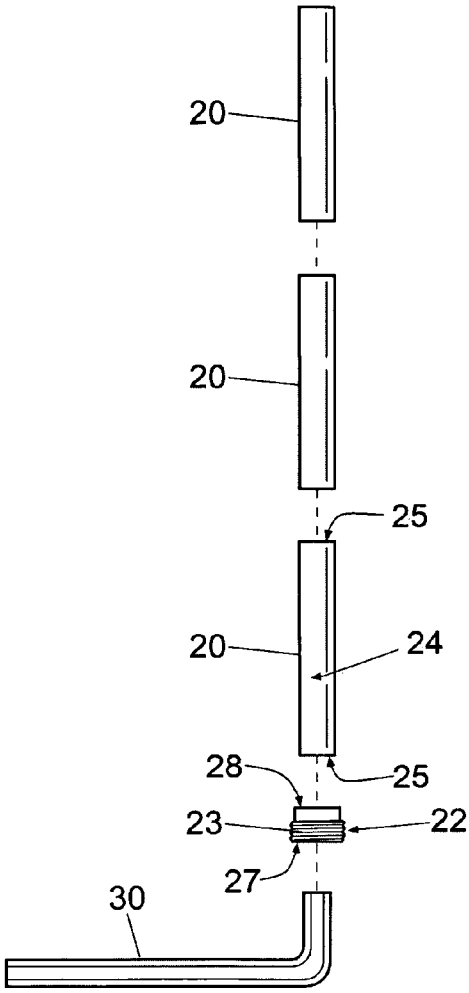
FIG. 3 illustrates in exploded, enlarged fashion a series of three (3) weights with the fastener and Allen wrench.

For a better understanding of the invention and its operation, turning now to the drawings, FIG. 1 depicts preferred golf club 10 having head 11 attached to shaft 12 with grip 13 affixed to shaft 12. Golf club 10 is a typical putter also shown in enlarged, fragmented form in FIG. 2 and may take on any of a myriad of designs. As shown in FIG. 2 head 11 of golf club includes weight port 18 positioned behind club face 17. Shaft 12 is hollow at its lower end as it defines internal channel 19 which is in communication with weight port 18 whereby a cylindrical weight such as weight 20 with continuous, smooth outer wall 24 and opposing flat ends 25 (FIG. 3) can be manually inserted through port 18 and into channel 19. Port 18 includes machine threads 21 for engaging threads 23 on large diameter cylindrical section 27 of fastener 22 which also includes small diameter cylindrical section 28 as seen in FIGS. 2 and 3. Weight 20 which may be formed of metal, plastic or other suitable materials is inserted into shaft channel 19 and held in place by fastener 22. Fastener 22 includes an Allen head or hex groove 26 (FIGS. 2 and 6) requiring a hex tool such as Allen wrench 30 seen in FIG. 3 for rotation purposes. Weight 20 is cylindrical in shape and has a diameter less than the diameter of internal channel 19 for accommodation in channel 19 though other weight shapes may also be used for the desired, precise weight sought for a particular golfer.

Figure 4:
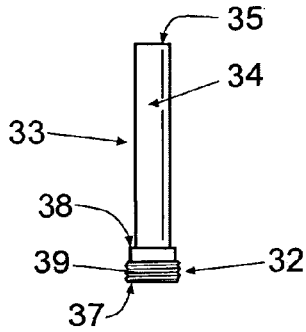
FIG. 4 shows an alternate embodiment of the weight rigidly affixed to the fastener.

In FIG. 3, three (3) such weights 20 are shown with each weight having a mass of approximately twenty five grams (25 g). Thus a golfer can select a club such as club 10 shown in FIGS. 1 and 2 and by adjusting the weights therein can choose the best weight combination suited for his particular swing. As further shown in FIG. 3, fastener 22 is separate and independent of weights 20 whereas in FIG. 4, alternate weight 33 is shown with fastener 32 rigidly affixed thereto such as by welding, brazing, soldering or adhering with a suitable adhesive. Alternate weight 33 like weight 20 includes a continuous, smooth outer wall 34 and a flat end 35. Fastener 32 includes large diameter cylindrical section 37 with threads 39 and small diameter cylindrical section 38 affixed to weight 33 as described above. As would be understood, alternate weight 33 is manufactured in different lengths and weights to allow, for the same weight adjustability as hereinbefore described for weights 20.

Figure 5:
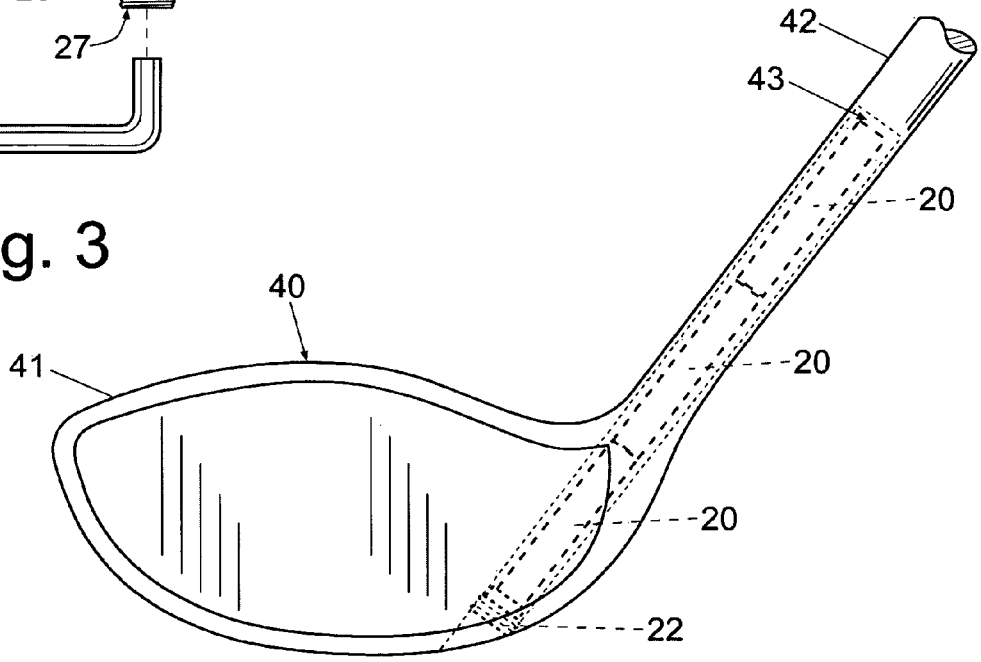
FIG. 5 pictures a partial front view of a driver with the weight system of the invention in place.
Figure 6:
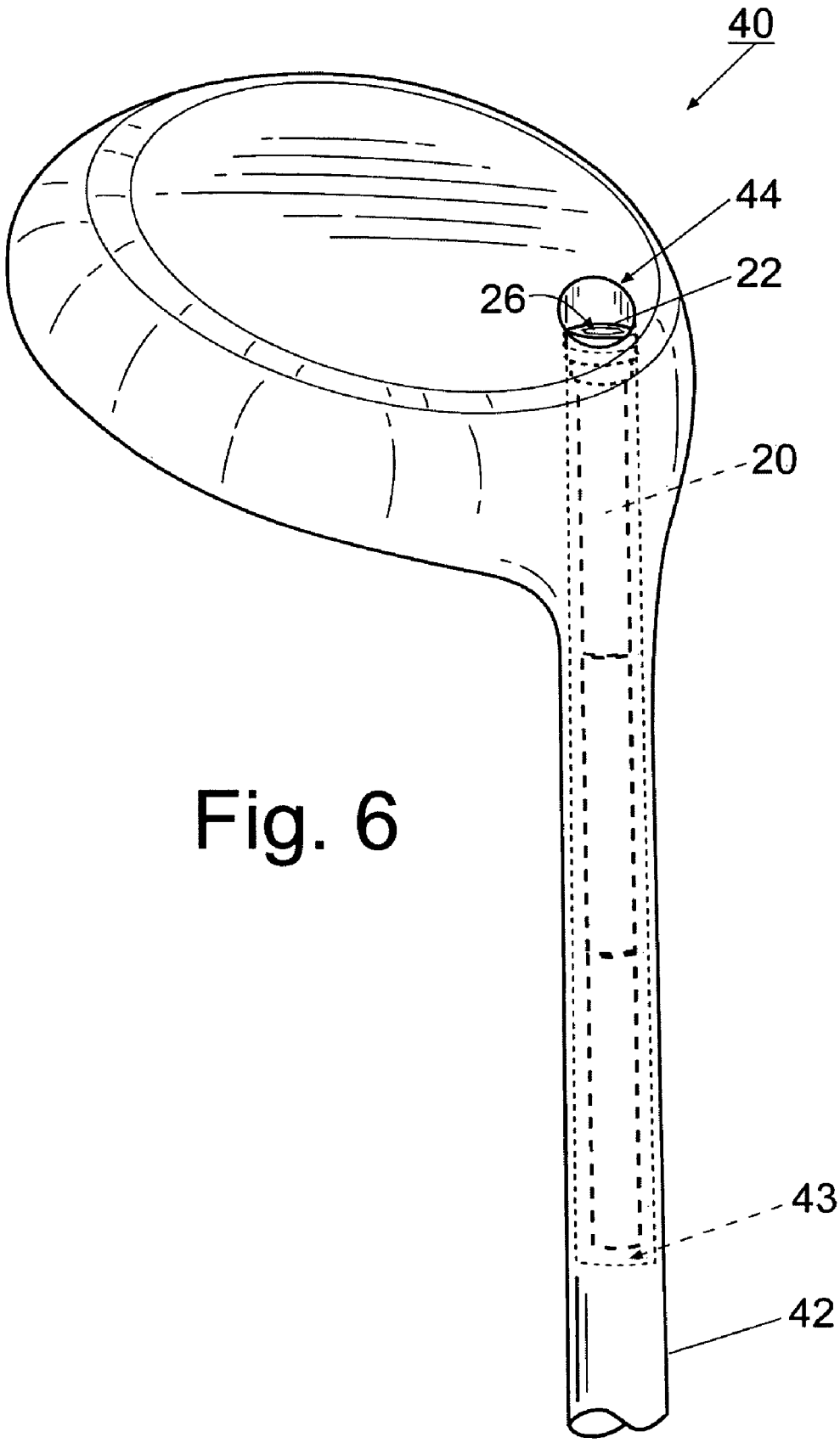
FIG. 6 shows a bottom perspective view of the driver as shown in FIG. 5.

In FIGS. 5 and 6 an alternate golf club is shown in the form of driver 40. Driver 40 includes head 41 which may be formed of wood or other suitable materials with shaft 42 joined thereto as usual. Head 41 includes weight port 44 (FIG. 6) which is in communication with internal channel 43 of shaft 42 which as shown in FIG. 5 contains three (3) cylindrical weights 20 as hereinbefore described. Flat ends 25 of weights 20 as seen in FIG. 5 abut end to end within longitudinal internal channel 43 of driver 40. Weights 20 are held in place by fastener 22 which is threadably received in weight port 44 shown in FIG. 6 to maintain weights 20 within channel 43 of shaft 42 whereby small diameter section 28 of fastener 22 abuts flat end 25 of weight 20 as seen in FIG. 5.

Alternative fastener (not shown) may be held in weight port by friction as by other types or kinds of fasteners as useful.

The adjustable golf club weight system as hereinbefore described provides a method for adjusting the weight of a golf club to suit an individual golfer and allows for adjusting the weight of each club individually at the time of play. The system permits adding or subtracting weights preferably in twenty-five gram (25 g) increments. Selected weights such as weights 20 shown in FIG. 3 are inserted one at a time through weight port 18 and into club shaft channel 19 as shown in FIG. 2. Once the selected amount of weights 20 are inserted, a fastener such as threaded fastener 22 is then threadably affixed in weight port 18 to maintain weights 20 therein. Club 10 can then be swung and played and if the selected weight or weights 20 are not suitable, the golfer can simply remove fastener 22 using a hex tool such as an Allen wrench 30 and thereafter add to or diminish the number of weights 20 chosen. With weights 20 adjusted and fastener 22 secured again in weight port 18, the golfer can then further use and experiment with the weights 20 chosen and make additional adjustments if necessary.

The illustrations and examples provided herein are for explanatory purposes and are not intended to limit the scope of the appended claims.

I claim:

1. A golf club weight system having a golf club and a weight joined to a fastener in combination, comprising:

a) a golf club, said golf club comprising: a head, a shaft, said head joined to said shaft, said shaft defining an internal longitudinal channel, said head defining a threaded port, said threaded port in communication with said internal channel, said head defining a face, said threaded port behind said face; and b) a weight joined to a threaded fastener, said weight defining a cylindrical shape with a smooth outer wall and one flat end, the other end of said weight attached to said threaded fastener, said threaded fastener positioned within said threaded port, said threaded fastener comprising a large diameter section and a small diameter section, said large diameter section defining threads thereon, said small diameter section cylindrically shaped, said small diameter section joined to said weight, said weight having a mass of about twenty-five grams, said weight having a diameter less than the diameter of said internal channel for insertion through said threaded port into said internal channel, whereby the weight of the golf club can be adjusted at the time of play.

2. The combination of claim 1 wherein said weight is formed from metal.

3. The combination of claim 1 wherein said golf club comprises a putter.

4. The combination of claim 1 wherein said threaded fastener defines a hex groove within said large diameter section.

5. The combination of claim 4 further comprising a hex tool, said hex tool comprising a wrench for insertion into said hex groove.

6. A method of adjusting the weight of a golf club at the time of play comprising the steps of:

a) providing a golf club and a weight joined to a threaded fastener, the golf club having a head defining a face with the head joined to a shaft behind the face, the shaft having an internal channel, the head defining a threaded port behind the face in communication with the internal channel for weight insertion, the weight having a cylindrical shape with a continuous outer wall, the threaded fastener having a large diameter section and a small diameter section, the large diameter section defining threads thereon with the small diameter section attached to the weight;

b) inserting the weight through the threaded port of the head into the internal channel of the shaft; and c) threading the fastener into the threaded port of the head to secure the weight in the internal channel of the shaft.

7. The method of claim 6 wherein providing a golf club and a weight joined to a threaded fastener comprises the step of providing a threaded fastener with a hex groove.

8. The method of claim 7 wherein providing a golf club and a weight joined to a threaded fastener comprises the step of further providing a hex tool for engaging the hex groove of the threaded fastener.

9. The method of claim 8 further comprising the steps of:

a) inserting the hex tool into the hex groove of the threaded fastener; and b) rotating the hex tool, threaded fastener and weight within the threaded port.

10. The method of claim 6 wherein providing a weight joined to a threaded fastener comprises the step of providing a weight of about twenty-five grams.

* * * * *